United States Patent [19]

Kane, III et al.

[11] 4,307,971

[45] Dec. 29, 1981

[54] SIDESHIFT ERASE APPARATUS AND METHOD FOR IMPACT PRINTERS

[75] Inventors: Milburn H. Kane, III, Round Rock, Tex.; Thomas M. Paulson, Lexington, Ky.

[73] Assignee: International Business Machines Corporation, Armonk, N.Y.

[21] Appl. No.: 96,280

[22] Filed: Nov. 21, 1979

Related U.S. Application Data

[63] Continuation of Ser. No. 873,197, Jan. 30, 1978, abandoned.

[51] Int. Cl.[3] ..... B41J 29/26; B41J 19/58

[52] U.S. Cl. ..... 400/697; 400/304

[58] Field of Search ..... 400/697, 697.1, 210, 400/304, 303, 322, 466

[56] References Cited

U.S. PATENT DOCUMENTS

| | | | |
|---|---|---|---|
| 1,905,118 | 4/1933 | Nadell | 400/697 |
| 2,544,998 | 3/1951 | Kissell | 400/304 |
| 3,780,846 | 12/1973 | Kopek | 400/697.1 |
| 3,942,621 | 3/1976 | Karlan | 400/697 |

FOREIGN PATENT DOCUMENTS

| | | | |
|---|---|---|---|
| 415196 | 6/1925 | Fed. Rep. of Germany | 400/304 |
| 2301565 | 11/1973 | Fed. Rep. of Germany | 400/697 |
| 2511527 | 11/1975 | Fed. Rep. of Germany | 400/697 |
| 528589 | 11/1940 | United Kingdom | 400/697 |

OTHER PUBLICATIONS

IBM Technical Disclosure Bulletin, vol. 13, No. 11, Apr. 1971, Single Character Storage, Okcuoglu, 3500.

IBM Technical Disclosure Bulletin, vol. 20, No. 9, Feb. 1978, Bold Image Typing, Brown, 3555.

*Primary Examiner*—Clyde I. Coughenour

*Attorney, Agent, or Firm*—George E. Grosser

[57] ABSTRACT

Erase apparatus for a typewriter utilizes a special double strike technique to permit quality erasures at normal character overstrike accuracies. The unwanted character is overstruck first slightly to one side and then slightly to the other side in the escapement direction. A preferred range to achieve apparently complete erasures occurs at sideshift distances between two and twenty percent of an average character escapement. In a presently preferred implementation, position codes are produced which cause the normal typewriter escapement apparatus to move the type carrier to the special striking positions for erasing.

16 Claims, 9 Drawing Figures

ERASE AND TAPE LIFT CONTROL FLOW CHART

SIDESHIFT ERASE APPARATUS AND METHOD FOR IMPACT PRINTERS

This is a continuation of application Ser. No. 873,197 filed 1/30/78 now abandoned.

BACKGROUND OF THE INVENTION

1. Field of the Invention

The invention relates to methods and apparatus for erasing printed characters and more specifically to erasing by striking over the unwanted character.

2. Statement regarding the Prior Art

A great boon to typists, regardless of skill level, resulted when erasing shields and the unpleasant time consuming "rub-off" erasing procedure for typed characters gave way to "strike-over" erasing, i.e., erasing that involves a repeat striking of the unwanted character using either a cover-up material or an adhesive tape that lifts the unwanted character off the paper. Such strike-over erasing is faster and cleaner than the old procedure, and generally results in less noticeable erasures in the end product original.

Nevertheless, many sophisticated impact typing machines do not feature strike-over erasing. One possible reason for omission of this highly desirable feature is that the character placement accuracy of moderately-high-speed impact printers, such as the flexible-spoke ("daisy wheel") printing devices, is not sufficient to achieve an apparently complete erasure. More specifically, while type-bar and type-ball printers are usually adjusted to permit a return impact within the "lift-off zone" of a printed character—typically within ±0.005 cm of the original impression—medium to high speed printers (say those capable of printing at rates exceeding 30 characters per second) are generally incapable of consistently providing such strike-over accuracy. With flexible-spoke printers, this accuracy problem is thought to result mainly from vibrations in the long slender spokes and from striker alignment variations these being additive to the usual carriage positioning variations. Whatever the causes, it appears that significantly increased strike-over accuracy is possible only at an unduly high cost, if at all.

To avoid the above problems with overstriking characters for erasure purposes, recourse has been taken to erase techniques using block characters. These block characters have specially selected shapes that either singly or in cooperating groups cover the impression area for any given printed character. This special character overstriking technique requires, however, the addition of erase characters which are not useful for printing purposes and presents problems because the necessary striking force to make such characters effective for erasing, with their relatively large impact areas, results in paper blemishes that impair the appearance of the end product original.

Apparently because of the above outlined problems, medium to high speed printing units, as was mentioned above, typically do not feature strike-over erase and, if unwanted characters have been printed, they must either be erased with an abrasive eraser or painted over manually; otherwise, the page must be repeated to achieve a clean copy.

SUMMARY OF THE INVENTION

The invention involves a recognition that, rather than resort to special measures in seeking to increase the strike-over accuracy of a typewriter for permitting quality erasure of printed characters, quality erasure may be achieved at normal placement accuracies by purposely missing the printed character in a particular way. Indeed, we have found that ordinary character placement accuracy is generally adequate to assure complete erasures if the unwanted character is overstruck slightly to one side and then slightly to the other side in the escapement direction. This is believed to be the case because such strike position shifting allows the type element pressure pattern to remain generally along the "embossed" contours of the printed character while nevertheless extending the erase zone along the axis where overstrike inaccuracy is concentrated, i.e., the escapement axis. With this double-strike erase approach, the placement shifts on either side of the printed character are preferably a fraction of the character escapement and a shift increment in the range of 2 to 20 percent of the average character escapement has been found to be generally effective for achieving quality erasures. Within such range, it appears that erasures are complete for the various standard type fonts, as is, of course, desirable for those machines featuring changeable type. It should be noted that the term "printed character" as used herein refers to a pattern formed by an operation of a print unit at a single corresponding character position. Patterns formed by multiple overlapping printing operations are herein considered to be multiple distinct printed characters each referenced to an individual character position.

In a presently preferred implementation for a typewriter having an escapement detector and using an escapement count or code to control carrier position, the escapement detection resolution is a fraction (1/10 or 1/12) of the escapement for a character and advantage is taken of such resolution to utilize the standard escapement control apparatus in effecting erasures. More specifically, escapement position codes are generated which represent positions that are a fraction of the average character escapement from the position of the unwanted character, so that the carriage may be driven to such positions, for erase overstriking, by the normal escapement control apparatus. Other functions such as type element impacting and ribbon lifting are preferably triggered automatically as part of an erase sequence as is discussed more fully below. And, in a memory typewriter the character is preferably selected automatically based on a code in memory corresponding to the nominal erase position.

It should be appreciated that, as an alternative, the technique of the invention may be implemented by moving the type carrier to the position of the unwanted character (again normal accuracy suffices) and then using a separately controlled shifting apparatus mounted on the carrier to superimpose the necessary escapement increments for erasing according to the invention. Furthermore, it should be appreciated that either the type unit(s) or the paper holder or both may be transported to provide the relative motion for positioning.

It is also contemplated, for a high-speed version of the invention in a spoked wheel printer, that a special double solenoid arrangement for the impact hammer (described more fully below) may be introduced to permit a rapid second impact of the unwanted character for erasure purposes.

The invention will now be described in detail with reference to the drawing wherein.

Figure 1A:
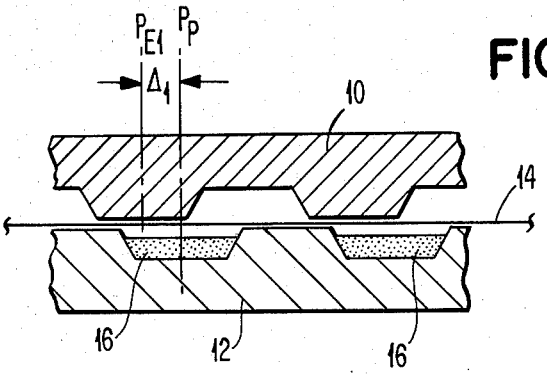
FIG. 1A and 1B are cross-sectional representations for teaching the basic erasure method according to the invention, the sections being taken parallel to the escapement axis.
Figure 1B:
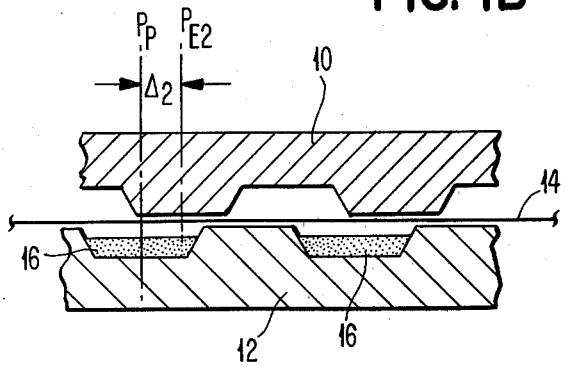

Referring to FIG. 1A, a type character 10 is about to impact a sheet of paper 12 on an erase stroke according to the invention. An erase tape 14 is interposed between the character 10 and the paper 12 to serve in "lifting off" the print medium 16 (hereinafter referred to as "ink") of the unwanted character. According to the invention, the type character 10 is the same one used for the unwanted printing and a shift is introduced along the escapement axis to establish a first erase position $P_{E1}$ at a distance $\Delta_1$ to one side of the original printing position $P_p$. Another shift is introduced to establish a second erase position $P_{E2}$ at a distance $\Delta_2$ to the other side of the original printing position $P_p$. By striking the character twice and so shifting the strike positions in relation to the original print position, as was discussed above, a complete erasure can be achieved without a requirement for special overstrike accuracy. Whats more, abnormal striking pressure is not required and objectionable paper blemishes do not result, at least with commonly used typing papers.

The following is a summary of test results for the technique of the invention using a "daisy wheel" printer (the Qume Model Q45). Escapement positions for the test erasures were controlled to high accuracy using a micrometer positioning mechanism.

| Test Set #1 (Normal Printing Force): | |
|---|---|
| Print Font - Prestige Elite | |
| Force Level - 34 lbs. | |
| Print Ribbon - IBM Correctable Film Ribbon | |
| Correction Tape - IBM Lift-Off Tape | |
| Printed Character - Y & M | |
| Minimum Shifts - ± .002" | |
| Maximum Shifts for Complete Erase - | |
| Paper Brand Name | Shift Increment ($\Delta_1$, $\Delta_2$) |
| Patapar | ±.016 in. |
| Cranes Crest | ±.012 in. |
| Plover | ±.012 in. |
| Weston Opaque | ±.011 in. |
| Lancaster Bond | ±.010 in. |

| Test Set #2 (Heavy Printing Force): | |
|---|---|
| Print Font - Diablo Manifold | |
| Force Level - 54 lbs. | |
| Print Ribbon - IBM Correctable Film Ribbon | |
| Correction Tape - IBM Lift-Off Tape | |
| Printed Character - Y & M | |
| Minimum Shifts - ±.002 in. | |
| Maximum Shifts for Complete Erasure - | |
| Paper Brand Name | Shift Increment |
| Cranes Crest | ±.010 in. |
| Plover | ±.010 in. |
| Patapar | ±.010 in. |

Based on these results, shift increments in a range of 2 to 20 percent of an average character escapement (typically 0.08 to 0.10 in.) or 4 to 40 percent of a nominal character width (around one half the escapement) are effective for erasures with various grades of paper and the more difficult to erase character, ie., Y and M. Moreover, dual erase strokes at normal positioning accuracy, but without side shifts, do not provide reliably complete erasures.

Figure 2:
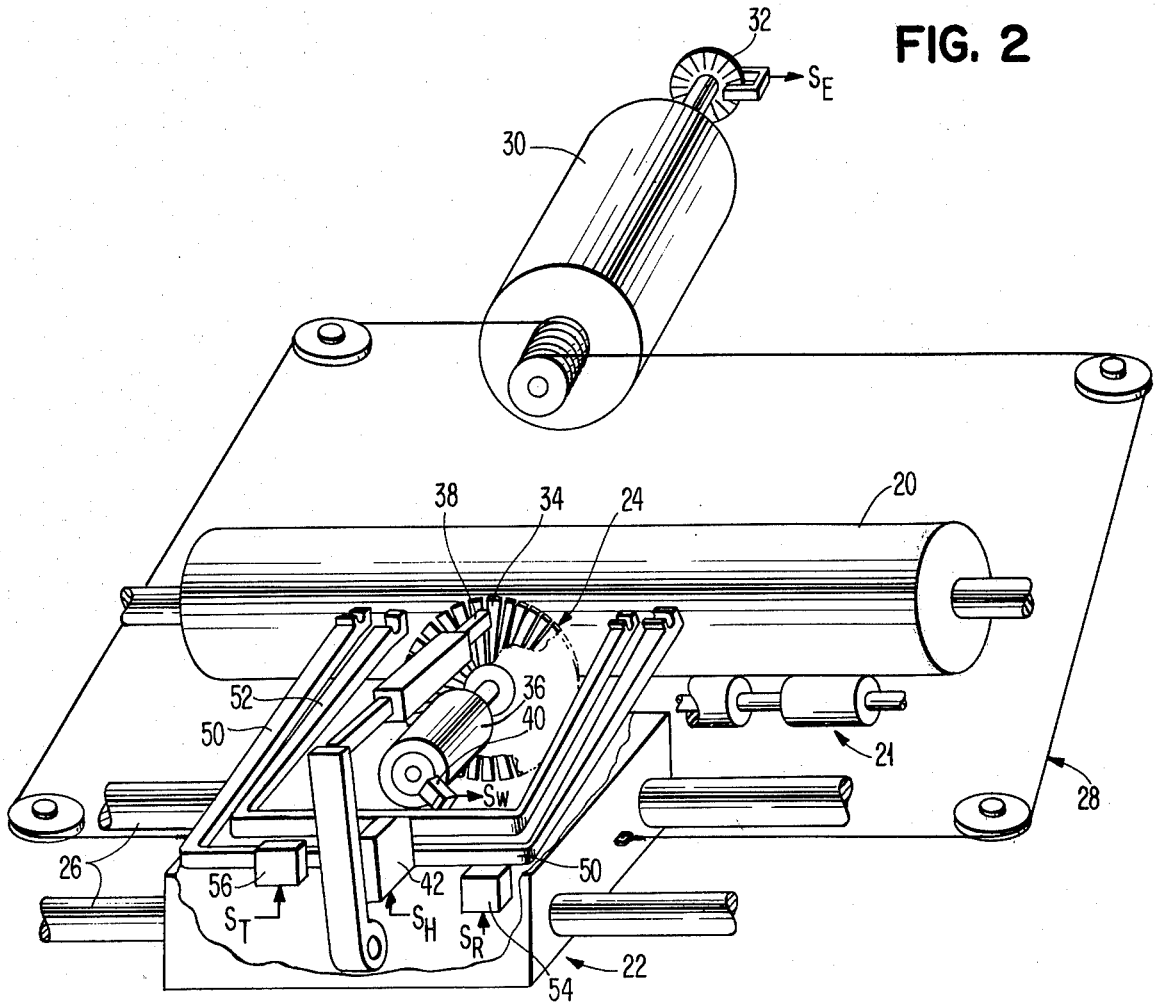
FIG. 2 is a simplified prespective representation of a carrier drive suitable for implementing the invention.

Now referring to FIG. 2 a presently preferred mechanism for implementing the invention includes a paper holder such as a platen 20 and associated paper guide rollers 21. A carrier 22 supports the character bearing type element 24 which is assumed to be a spoked ("daisy") wheel element. Positioning of the carrier 22 along an escapement axis parallel to the platen, established by a set of guide rails 26, is effected using a cable-pulley system 28 connected to a drive motor 30, as is well known in the art. Pulses $S_E$ indicating escapement increments are produced by a position transducer 32 that is connected to the shaft of motor 30. The angular resolution of the transducer 32 is preferably chosen to correspond to 47.24 pulses per centimeter (120 pulses per inch of escapement).

To print a character at a print position ($P_p$) along the escapement axis, a selected character element 34 of the type unit 24 is rotated by a motor 36 into alignment with a hammer 38. Such rotation is controlled, as is discussed in more detail below, based on position code signals $S_W$ produced by a position transducer 40.

Striking of the character is triggered by a signal $S_H$ applied to an electromagnetic actuator 42 having an armature 44 that pivots to drive the hammer 38 into the selected element (e.g., the element 34) of the type unit 24.

Ribbon lifters 50 and 52 serve to position printing and erase tapes respectively. Lifter 50 is caused to pivot by an actuator 56

Ribbon lifters 50 and 52 serve to position printing and erase tapes respectively. Lifter 50 is caused to pivot by an actuator 54 in response to a lift signal $S_R$ and lifter 52 is caused to pivot by an actuator 56 in response to the signal $S_T$.

Figure 3:
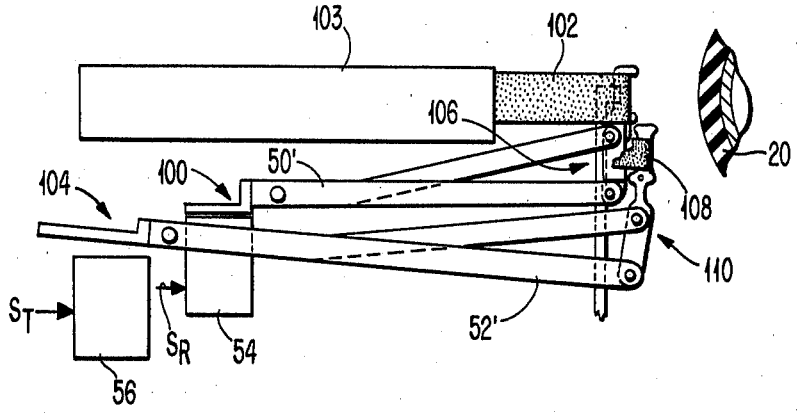
FIG. 3 is a side view of a ribbon lift mechanism for use according to the invention.

Referring to FIG. 3, apparatus 100 for positioning a printing tape or ribbon 102 (supplied from a cartridge 103) between the platen 20 and the character element 34 preferably includes an arm 50' coupled to the signal responsive actuator 54. The arm 50' drives guide linkage 106 to position the ribbon 102. Apparatus 104 for positioning an erase tape 108 between platen 20 and the character element 34 preferably includes an arm 52' coupled to the signal responsive actuator 56. The arm 52' drives guide linkage 110 to position the ribbon 108.

Figure 4:
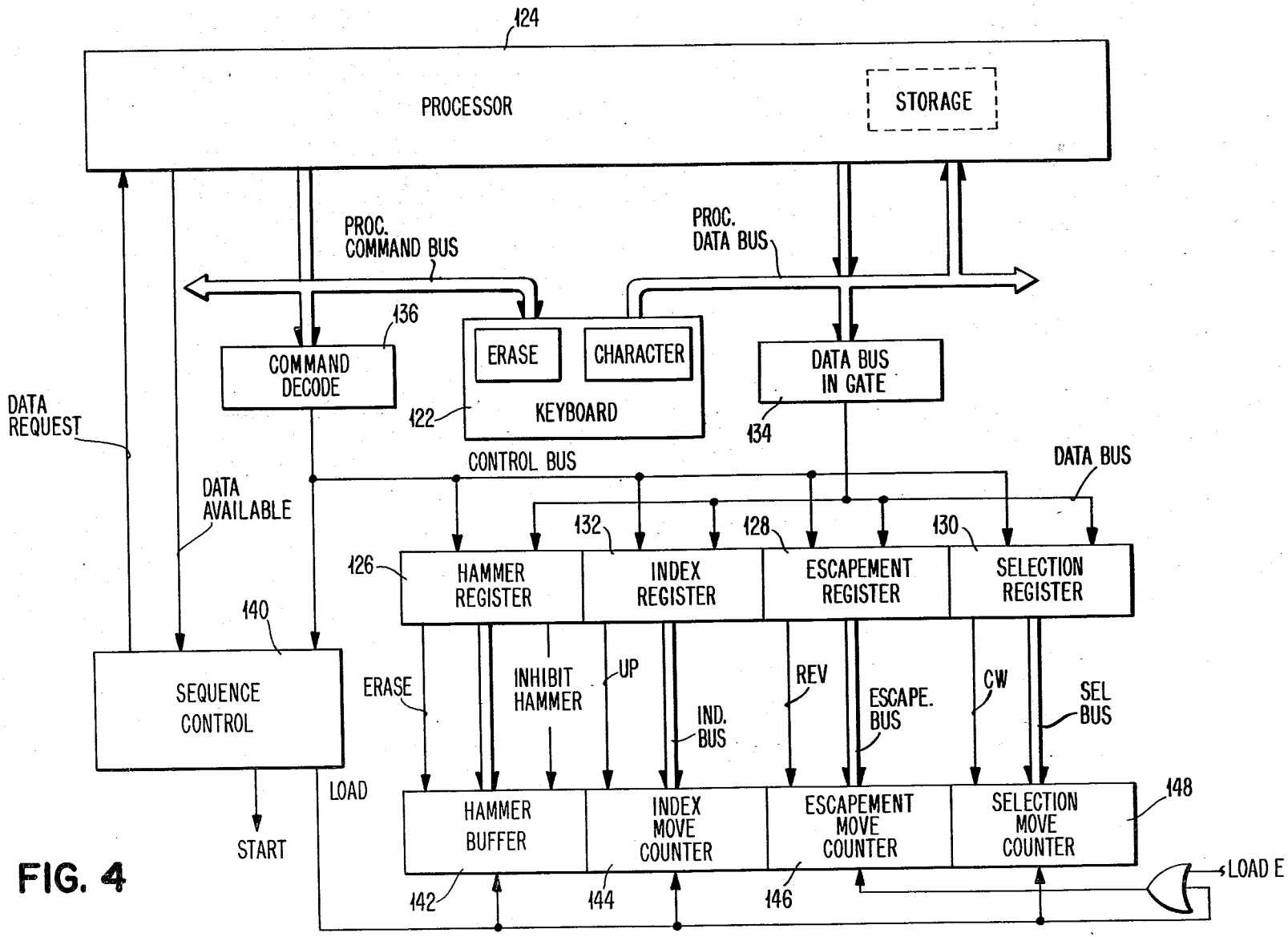
FIG. 4 is a system diagram in block form representing in part a presently preferred implementation for the invention.

Referring to FIG. 4 a signal processing arrangement 120 serves in initializing control signals for implementing the invention in a typewriter such as the Qume Model Q45. Erase and character selection signals from a manually operable keyboard 122 are supplied as data to a processor 124. Responsively the processor 124 raises an erase bit in a "hammer" register 126. An escapement code, representing the present escapement position, is entered in an "escapement" register 128 and a type character position code along with a direction bit (CW) are entered in a "selection" register 130. (An "index" register 132 is shown for completeness but will not be discussed further). Demultiplexing of information from a processor data bus gate 134 is coordinated by a command decoder 136 connected to the command bus of processor 124 as is well known in the data processing art.

A sequence control 140 triggers data transfers, via a "LOAD" signal, to a hammer buffer 142, an index move counter 144, an escapement move counter 146, and a selection move counter 148.

Figure 5:
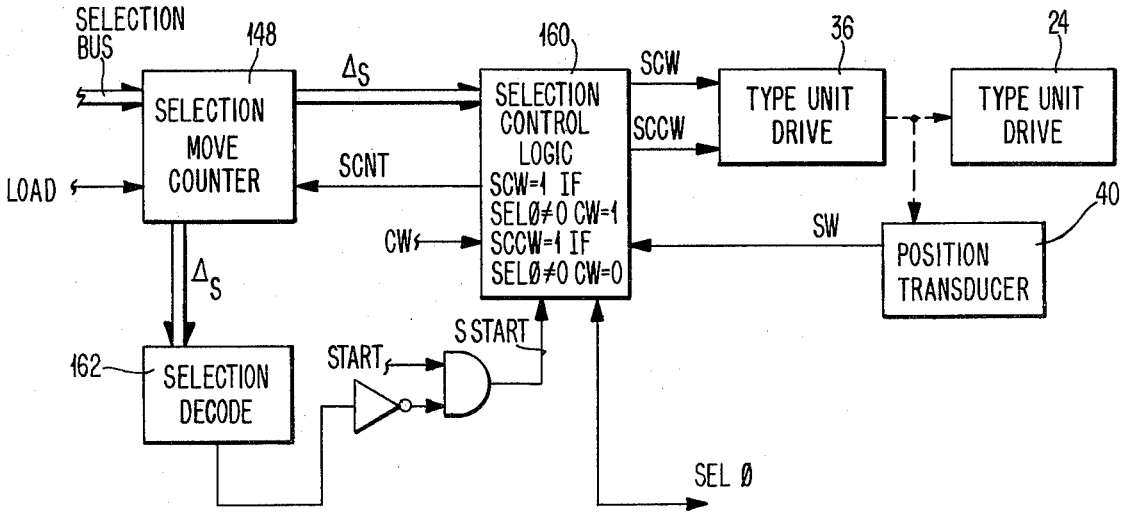
FIG. 5 is a system diagram representing a character selection apparatus for a wheellike type unit.

Referring to FIG. 5 circuitry for effecting code responsive selection of type characters includes a logic circuit 160 that sends signals SCW and SCCW to activate the motor 36 in either the clockwise or the counterclockwise direction respectively according to the state of signal CW from the selection counter. A selection movement is initiated in response to an SSTART signal when a non-zero code is entered in the selection move counter. A decoder 162 generates a logic signal SEL$\phi$ to indicate when the total $\Delta_s$ in counter 148 has been reduced to zero, i.e., the selection is completed.

Pulses to decrement the counter 148 are sent from logic circuit 160 based on the signal $S_W$ of transducer 40. The signal $\Delta_s$ indicates the distance from the commanded destination and as a refinement may be used by logic circuit 160 to control the speed of motor 36.

Figure 6:
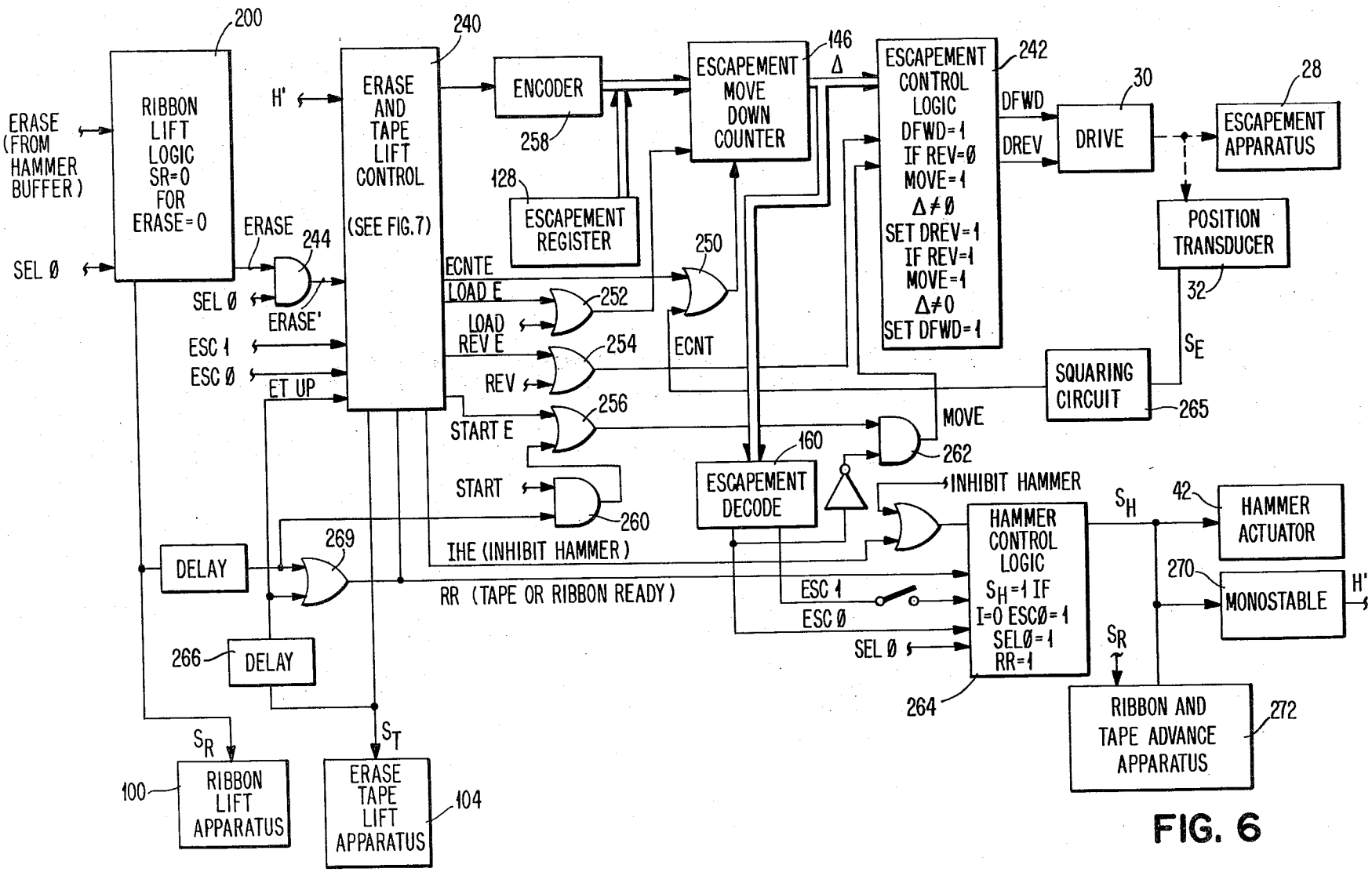
FIG. 6 is a system diagram in block form representing in part, the presently preferred implementation for the invention.

Referring to FIG. 6, printing ribbon lift logic 200 responds to the signal SEL$\phi$, which, as was discussed above, signals completion of a selection, and the ERASE signal (produced by the processor 124 in response to operator actuation(s) of the keyboard 122) to control the position of the print ribbon 102 (FIG. 3) via signal $S_R$ and the ribbon lift apparatus 100.

Escapement movements for implementing the invention, as was discussed above, preferably involve the normal typewriter escapement mechanism. An erase-and-tape-lift control 240 "tricks" the normal escapement control logic 242 into cooperation by sending special erase control signals through gates 250, 252 and 256, and introducing erase shift values by means of an encoder 258. More specifically, STARTE is a special operation initiating signal for erase, LOADE is a special load command for counter 146, REVE is an escapement direction command signal for erase, and ECNTE is an incrementing signal to the counter 146 (similar signal labels without the final E identify corresponding signals used for normal operation).

The control 240 is sequential and may be implemented, for example, in a microprocessor, preferrably the processor 124, using techniques well known in the art. A description of the control 240 is provided in FIG. 7 in terms of a sequence of comparison and command operations.

An erase sequence begins with an erase command (ERASE) arriving at the buffer 142 (FIG. 4) and a selection code arriving at the selection move counter 148. When a type character selection operation is completed by the selection circuitry of FIG. 5, the signal SEL$\phi$ is set to logic 1 and a signal ERASE1 is produced by a gate 244. Referring again to FIG. 7, the control 240 first checks the state the signal ERASE' (block 700) and, for a logic 1 condition, responds by pulsing the signal LOADE to a logic 1 state (block 702), thereby causing the escapement value from the register 128 to be loaded in the move counter 146 (see also FIG. 6).

A count pulse ECNTE is then applied at gate 250 (block 704) to decrement the counter 146 and the signal REVE is set to logic 1 (block 706) and passes through gate 254 to the escapement control logic 242. Such a command sequence prepares the way for an escapement movement to a position one escapement increment (preferably 1/120") beyond the print position of the unwanted character. Escapement movement is triggered by raising the STARTE signal to a logic 1 state (block 708). The STARTE signal passes through a gate 256 (which also receives the normal START signal) to a gate 262. At the gate 262, a MOVE signal is raised to logic 1 if a decoder 268 indicates that the total $\Delta$ at the counter 146 is not zero (i.e., the inverse of the signal indicating arrival at a destination (ESC$\phi$) is at logic 1).

The direction of escapement caused by the drive motor 30 is conditioned to be forward or reverse respectively by signal DFWD and DREV. Motion of the drive motor 30 is transmitted to the escapement apparatus 28 and the position transducer 32 which produces the feedback signal $S_E$. The signal $S_E$ triggers a corresponding ECNT pulse, from a squaring circuit 265, that decrements counter 146.

Figure 7:
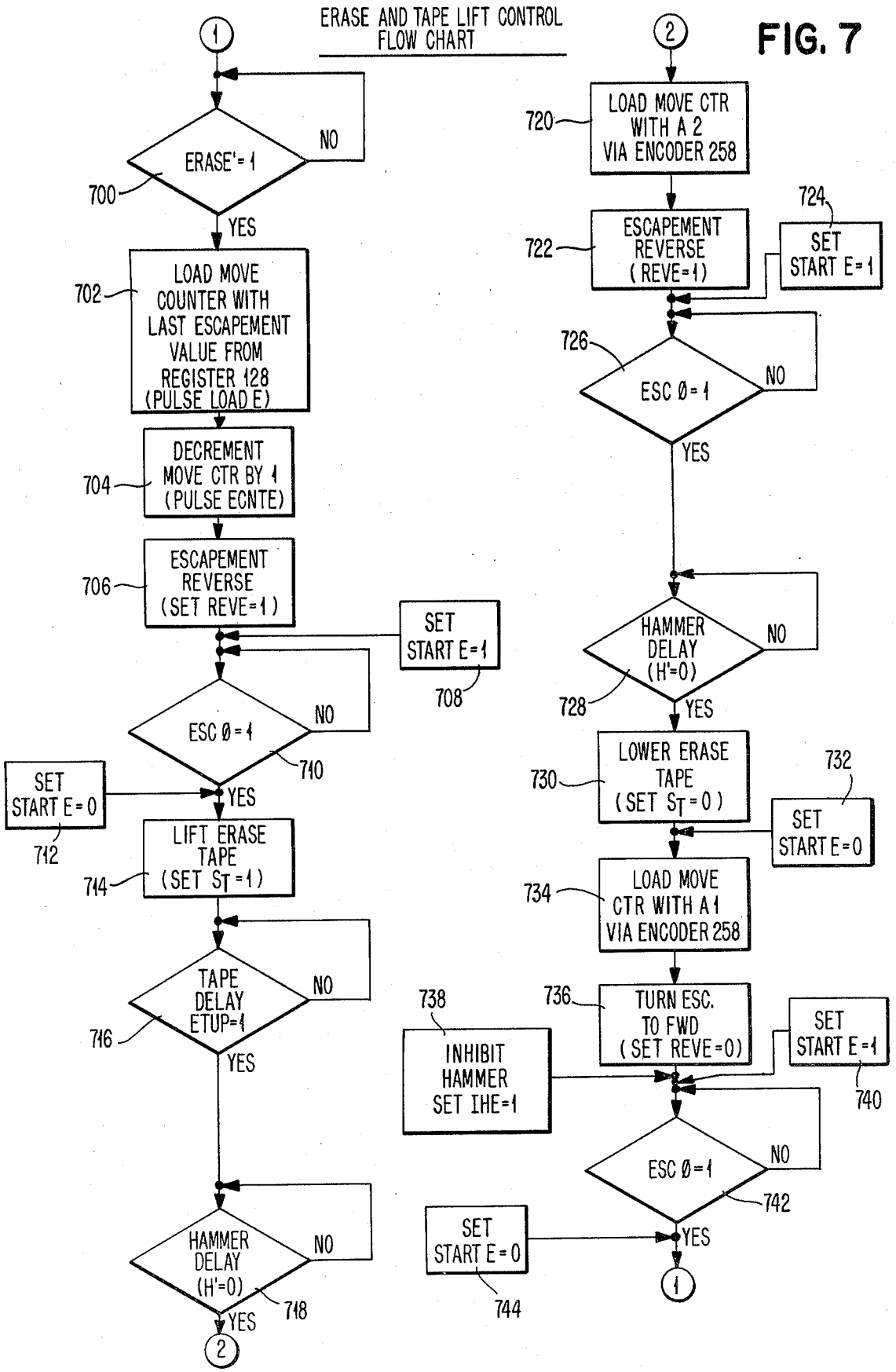
FIG. 7 is a flow chart indicating a preferred sequencing of operations for erasures according to the invention.

When the escapement destination is achieved, the signal ESC$\phi$ is set to logic 1 and the test at block 710 of FIG. 7 is satisfied.

Such destination is one escapement increment from unwanted character position and is a first erase position according to the invention. Signal STARTE is set to logic 0 (block 712) and the erase tape lift signal $S_T$ is set to logic 1 (block 714). After a delay at device 266 that corresponds to the operating time of tape lift apparatus 104, the signal $S_T$ becomes (denoted ETUP after delay) indicates that the erase tape is in operative position (see block 716). The signal ETUP passes through gate 269 to the hammer control logic 264 (i.e., raises signal RR to logic 1). Such conditioning of signals ESC$\phi$, RR, SEL$\phi$ along with signal IHE remaining at logic 0 causes the hammer control logic 264 to send out a hammer pulse $S_H$ to the hammer actuator 42. The pulse $S_H$ is also received by a monostable circuit 270 that produces a signal H' after a delay corresponding to the hammer actuation time, a ribbon and tape advance apparatus 272, and the control 240 (see block 718, FIG. 7).

An erase "on the fly" may be achieved by triggering the hammer pulse $S_H$ in response to a signal ESC1 that indicates the carrier is one escapement increment from the destination.

With the first erase stroke now completed, the escapement move counter 146 is loaded with a two increment count via encoder 258 (block 720), which count represents the displacement to the second striking position. The signal REVE remains at logic 1 (block 722) and the signal STARTE is set to logic 1 (block 724) so that an escapement operation similar to that described above commences and continues until the signal ESC$\phi$ goes to a logic 1 state (see block 726, FIG. 7). In this condition the hammer control logic sends out a hammer actuating pulse $S_H$ and logic 240 waits until the signal H' goes to logic 0 state (see block 728, FIG. 7). With the second erase stroke completed, the erase tape is lowered by setting the signal $S_T$ to logic 0 (block 730).

To return to the unwanted character position, the signal STARTE is set to logic 0 (block 732) and the escapement move counter 146 is loaded with a one increment count via the encoder 258 (block 734). The signal REVE is set to logic 0 (block 736) to cause forward escapement and the hammer inhibit signal IHE is set to logic 1 (block 738). Escapement operation is then commenced by setting the signal STARTE to logic 1 (block 740). For this condition, escapement occurs until the position of the erased character ($P_P$), is reached at which position the signal ESC$\phi$ is set to logic 1 by decoder 268 (see block 742, FIG. 7). The signal STARTE is then set to logic 0 (block 744) to complete the operational sequence for control 240.

Figure 8:
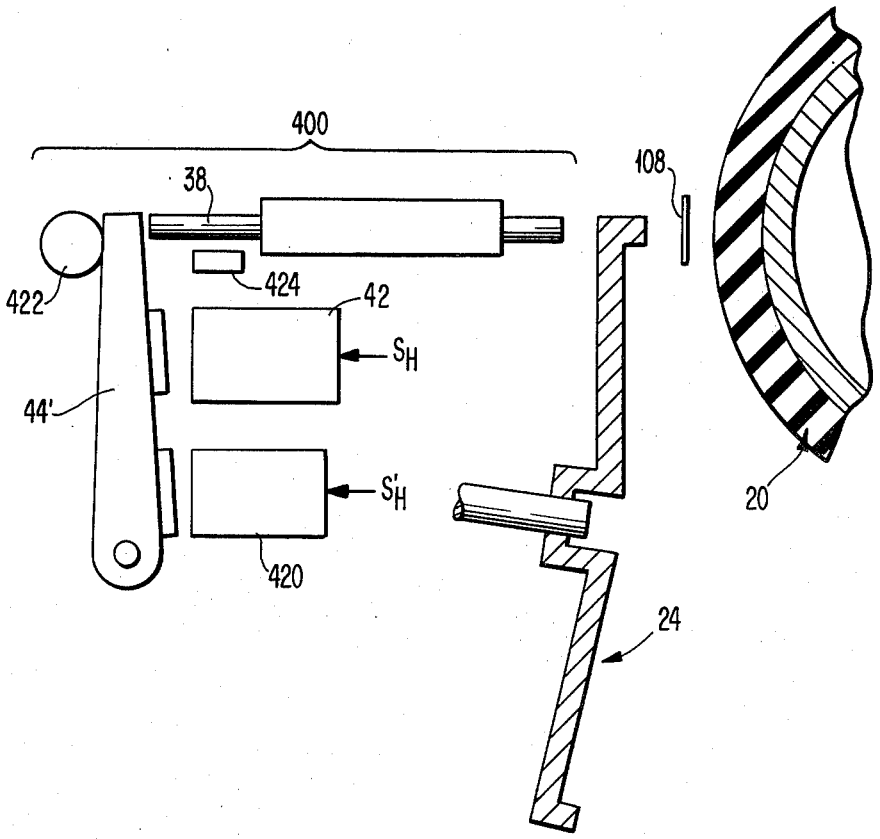
FIG. 8 is a side view of a dual solenoid hammer for a special implementation according to the invention.

Referring to FIG. 8, a special hammer apparatus 400 for high speed erase has dual solenoids 42 and 420 to permit rapid repeat impacting of hammer 38 for erase operations. The second hammer actuation indicated in the operating sequence of FIG. 7 would, for such implementation, actuate the solenoid 420 by a signal $S'_H$ in order to avoid delay (because of circuit inductance) between successive solenoid firings. A set of abutments 422 and 424 serve to limit the stroke of armature 44'.

Figure 9:
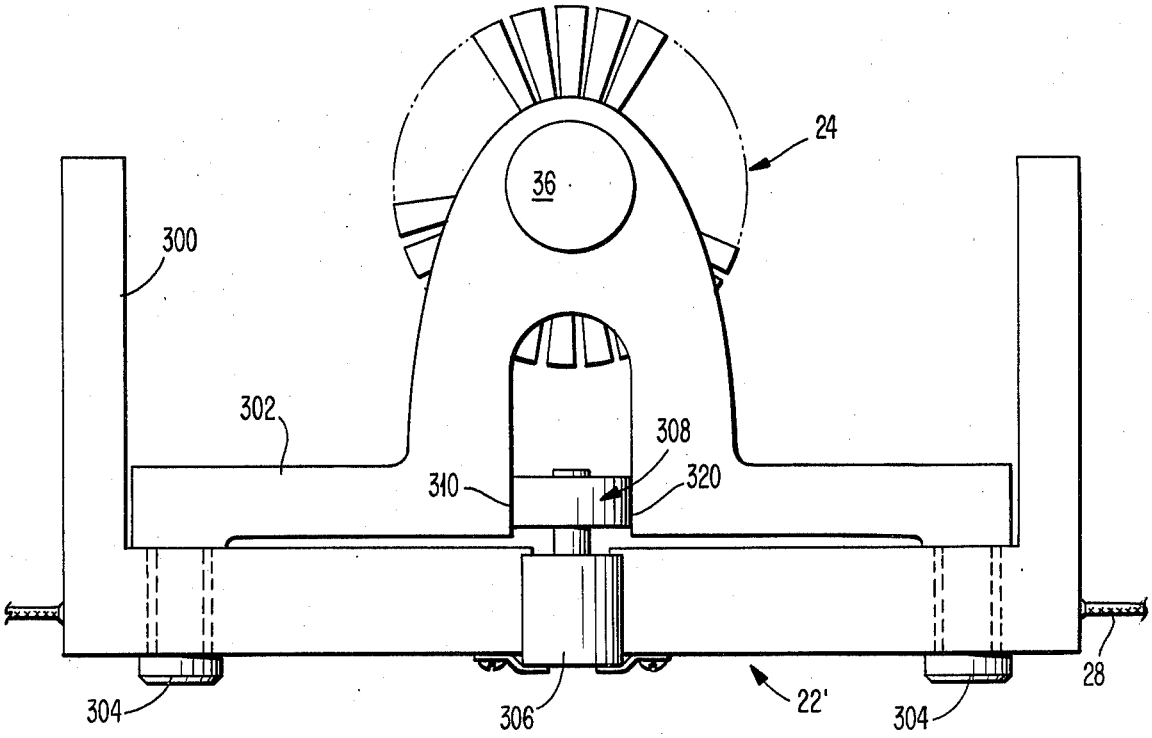
FIG. 9 is a front view of a carrier assembly implementing an alternative for introducing sidewise shifting to establish erase strike positions.

As an alternative for establishing erase positions for erasure according to the invention, the apparatus of FIG. 9 produces side shifts from a print position independently of the normal carrier positioning apparatus. A carrier frame 300 supports a mounting frame 302 for sliding motion paralleling the escapement axis by virtue of guide pins 304 which ride in elongate slots. Controlled escapement direction shifts for erase are produced by a motor 306 which drives an eccentric cam 308 against camming surfaces 310 and 320 of mounting frame 302. Erase striking is timed to occur at extreme escapement direction positions of the cam 308.

The invention has been described in detail with reference to the drawing but it will be appreciated that variations and modifications are possible which come within the spirit and scope of the invention. For example, either lift-off or cover-up media may be used to apparently remove the unwanted printed character and the erase positioning apparatus may either involve the normal carrier drive or independent shift apparatus. Further, the type unit may be a type bar, type ball, daisy wheel, or any other variety used for impact printing. And, in a typewriter having a storage for codes representing type characters on a line the means for selecting a type character for erase may be a table lock up logic that extracts the code corresponding to the erase position.

What is claimed is:

1. In a typewriter including a wheel having type characters, a platen, a type ribbon interposed between said element(s) and said platen, a signal actuated hammer apparatus for driving a type character positioned at a striking site toward said platen to print a character, means for causing relative motion between said wheel and said platen along an escapement axis, which motion defines character printing positions at measured escapement increments, apparatus for effecting erasure of an unwanted printed character resulting from a hammer apparatus actuation at a respective character printing position comprising:

means for identifying a corresponding type character and a character printing position for erase;

means responsive to said identifying means for causing the identified type character to be moved to a striking site corresponding to said identified character printing position;

means for causing relative motion between said wheel and said platen to establish a first erase overstrike position slightly offset to one side of said identified character printing position and a second erase overstrike position slightly offset to the other side of said identified character printing position relative to the escapement axis, whereby the erase overstrikes overlap to some degree each other and together the whole of the unwanted printed character;

means for supplying an activating signal to said hammer apparatus at said each of said erase overstrike positions; signal responsive ribbon displacement means for positioning an erase ribbon between said wheel and said platen; and means for triggering said ribbon displacement at least during activation of said hammer at said erase positions to interpose said ribbon between said platen and said wheel, whereby an erasure is effected.

2. An erasure apparatus according to claim 1 wherein said hammer apparatus has individual solenoids that are actuated at respective erase overstrike positions.

3. Erasure apparatus according to claim 2 wherein said relative motion causing means is a circuit cooperating with said escapement means, which circuit includes means for producing signals to command said escapement means to position said wheel at said erase overstrike positions.

4. Erasure apparatus according to claim 2 wherein a carrier supports said wheel and said relative motion causing means is a mechanism that shifts said wheel in relation to said carrier.

5. For use in an impact printer of the kind having at least one element that bears type for various characters, a paper holder, and means for producing relative movement between the type element(s) and the paper holder along an escapement axis to establish discrete character printing positions along a print line, which positions are defined in producing character imprints and are characterized by separation distance(s) selected from a predefined set thereof respective of the printed characters, apparatus for erasing an unwanted single-impact character imprint existing at a character printing position comprising:

means for producing an erase signal identifying as an erasure position said character printing position of said unwanted single-impact character imprint;

means for selecting a type character for erasure that corresponds to the unwanted single-impact character imprint;

shifting means, responsive to said erase signal, for causing relative movement along the escapement axis between said type element(s) and said paper holder to establish a first erase strike position that is shifted to one side of the erasure position and then to establish a second erase strike position shifted to the other side of the erasure position, the strike position shifts being small in relation to the average of said set of separation distances; and means cooperating with said shifting means for producing movement to impact the selected type character with the paper holder at the first and second erase strike position, which character impacts overlap, whereby the erase strokes overlap to some degree each other and together the whole of said unwanted character imprint to effect erasure of said unwanted character imprint.

6. Erase apparatus according to claim 5 but further including an erase ribbon and means for moving the erase ribbon to be between the selected type character and the paper holder, at least during character impact intervals at the first and second erase strike positions.

7. Erase apparatus according to claim 5 wherein said average is one-tenth of an inch and said erase strike positions are within a distance from said character printing position that is between 0.002 and 0.02 inches.

8. Erase apparatus according to claim 7 wherein the means for producing an erase signal and the means for selecting a type character include manually operated keys.

9. In an impact printer having means for supporting type characters, a paper holder for retaining an imprint receiving medium and means for causing relative motion between said element(s) and said paper holder along an escapement axis which motion defines character printing positions along a line at measured escapement increments, apparatus for use in effecting an erasure of an unwanted single stroke character imprint, on said receiving medium, at a character printing position that corresponds to one of said type characters comprising:

means for producing an erase command signal corresponding to the character printing position of said unwanted single stroke character imprint;

means for producing a selection signal representing said type character corresponding to the single-stroke character imprint;

means responsive to said selection and erase signals for automatically positioning said type supporting means to have strike positions a small fraction of a single character escapement to either side of said character printing position, said positioning means including means for selecting the type character corresponding to the selection signal and for striking that type character at both erase positions, whereby the erase strokes overlap to some degree each other and together the whole of the character imprint to be erased; and means for interposing an imprint erase material between said type character and said receiving medium, whereby an erasure of said single-stroke character imprint may be effected.

10. Erasure apparatus according to claim 9 wherein said strike positions are located between 2/100 to 20/100 of an escapement increment for a single character on either side of said character printing position.

11. In a typewriter having at least one character-bearing type element, a platen for holding a receiving medium, a type ribbon interposed between said element(s) and said platen, means for driving said element(s) toward said platen to print a character, escapement means for causing relative motion between said element(s) and said platen along an escapement axis, which motion defines character printing positions at measured escapement increments, apparatus for effecting erasure of a single-stroke printed character occurring at a corresponding one of said character printing positions, said apparatus comprising:

means for producing an erase command signal corresponding to said one character printing position;

means for producing a code representing a type character corresponding to said printed character;

means responsive to said code for causing selection movement of the erase character;

erase positioning means for causing relative motion between said element(s) and said platen to establish erase overstrike positions slightly to one side of an then slightly to the other side of said one character printing position, relative to the escapement axis;

means for activating said element driving means at first and second erase overstrike positions to strike said selected type character at said platen, whereby the erase strokes overlap to some degree each other and together the whole of the character to be erased;

signal responsive ribbon displacement means for interposing an erase ribbon between said type character and said platen; and means for triggering said ribbon displacement means at least during activation of said element driving means at said erase positions, whereby an erasure of said single-stroke printed character is effected.

12. In a typewriter having at least one type-character bearing element, a platen, a type ribbon interposed between said element and said platen, means for driving the said element(s) toward the platen to print a character, means for causing relative escapement movement between said element(s) and said platen that defines character positions along a line at measured escapement increments, apparatus for effecting erasure of single-stroke printed character comprising:

means for producing an erase command signal corresponding to the position of the single-stroke printed character;

means for producing a code representing the individual single-stroke printed character;

means responsive to said erase command for causing a relative motion to a first erase position a small fraction of an escapement increment to one side and to a second erase position a small fraction of an escapement increment to the other side of the position of said single-stroke printed character;

means for displacing said type ribbon to an erase position and for displacing an erase ribbon to be interposed between said element and said platen in response to the erase command;

means responsive to said code for selecting the corresponding type character; and means for driving said element to said platen at said first and second erase positions, whereby the erase strokes overlap to some degree each other and together the whole of the character to be erased.

13. A method for erasing a printed character produced at a single character position along a type line on a receiving medium by a single character printing operation of a printing unit, said erasing method comprising:

positioning said print unit to strike said character at a first area that overlaps but is slightly offset to one side of the area of said printed character;

positioning an erase medium between said type character and said printing character;

striking said character against said receiving medium and the interposed erase medium at said first area;

repositioning said print unit to strike at a second area that overlaps but is slightly offset to the other side of the area of said printed character position; and striking said character against said receiving medium and the interposed erase medium at said second area, whereby the erase strokes overlap to some degree each other and together the whole of the character to be erased.

14. A method according to claim 13 wherein said first and second areas are offset from the printed character respective distances that are greater than 0.002 inches and less than 0.02 inches.

15. A method according to claim 13 wherein the erasing medium includes a transfer material corresponding in color to said receiving medium.

16. A method according to claim 13 wherein the erasing medium includes an adhesive ink lift-off material.

* * * * *